US008979479B2

(12) United States Patent
Steiger et al.

(10) Patent No.: US 8,979,479 B2
(45) Date of Patent: Mar. 17, 2015

(54) GAS TURBINE

(75) Inventors: Ulrich Steiger, Baden-Dättwil (CH); Carlos Simon-Delgado, Baden (CH); Axel Heidecke, Wettingen (CH); Thomas Zierer, Ennetbaden (CH); Robert Marmilic, Nussbaumen (CH)

(73) Assignee: Alstom Technology Ltd, Baden (CH)

( * ) Notice: Subject to any disclaimer, the term of this patent is extended or adjusted under 35 U.S.C. 154(b) by 811 days.

(21) Appl. No.: 12/882,409

(22) Filed: Sep. 15, 2010

(65) Prior Publication Data

US 2011/0070077 A1 Mar. 24, 2011

(30) Foreign Application Priority Data

Sep. 23, 2009 (EP) ..... 09171142

(51) Int. Cl.

| | |
|---|---|
| ***F03B 11/02*** | (2006.01) |
| ***F01D 9/04*** | (2006.01) |
| ***F01D 5/08*** | (2006.01) |
| ***F01D 11/00*** | (2006.01) |
| ***F01D 25/12*** | (2006.01) |

(52) U.S. Cl.

CPC ..... *F01D 9/04* (2013.01); *F01D 5/081* (2013.01); *F01D 11/005* (2013.01); *F01D 25/12* (2013.01); *F05D 2240/10* (2013.01); *F05D 2240/81* (2013.01)

USPC ..... 415/115; 415/173.7

(58) Field of Classification Search

USPC ..... 415/115, 116, 117, 170.1, 173.7

See application file for complete search history.

(56) References Cited

U.S. PATENT DOCUMENTS

| | | | | |
|---|---|---|---|---|
| 4,425,079 | A * | 1/1984 | Speak et al. | 415/139 |
| 4,456,427 | A * | 6/1984 | Evans et al. | 416/95 |
| 4,666,368 | A | 5/1987 | Hook, Jr. et al. | |
| 4,882,902 | A | 11/1989 | Reigel et al. | |

(Continued)

FOREIGN PATENT DOCUMENTS

| | | |
|---|---|---|
| EP | 0636765 | 2/1995 |
| FR | 1351268 | 1/1964 |

(Continued)

OTHER PUBLICATIONS

European Search Report from EP Patent App. No. 09171142.4 (Apr. 6, 2010).

(Continued)

*Primary Examiner* — Dwayne J White
*Assistant Examiner* — Justin Seabe
(74) *Attorney, Agent, or Firm* — Buchanan Ingersoll & Rooney PC

(57) ABSTRACT

A gas turbine (1) includes a combustion chamber (2) followed by a stator airfoil row (4) defining a plurality of guide vanes and separated by the combustion chamber (2) by a first gap (5), and a rotor airfoil row (6) separated by the stator airfoil row (4) by a second gap (7). The stator airfoils (15) of the stator airfoil row (4) are connected to guide vane boxes (17) collecting a cooling fluid (A) and injecting it through nozzles (20) in the second gap (7) to make it to enter rotor airfoil inlets (23). The guide vane boxes (23) are provided with passages (30) connecting a zone (31) upstream of the guide vane boxes (17) to a zone (32) of the second gap (7) downstream of the guide vane boxes (32). Moreover, the mouths (3) of the passages (30) facing the rotor airfoil row (6) are closer to a hot gases path than the nozzles (20).

8 Claims, 3 Drawing Sheets

(56) References Cited

U.S. PATENT DOCUMENTS

| | | | | |
|---|---|---|---|---|
| 5,135,354 | A | 8/1992 | Novotny | |
| 7,137,777 | B2 * | 11/2006 | Fried et al. | 415/115 |
| 7,189,055 | B2 * | 3/2007 | Marini et al. | 415/115 |
| 8,262,342 | B2 * | 9/2012 | Morris et al. | 415/115 |

FOREIGN PATENT DOCUMENTS

| | | | |
|---|---|---|---|
| GB | 2100360 | | 12/1982 |
| GB | 2246836 | | 2/1992 |
| JP | H07139372 | A | 5/1995 |
| JP | 2010-196501 | A | 9/2010 |

OTHER PUBLICATIONS

Office Action (Notification of Reasons for Refusal) issued on Apr. 7, 2014, by the Japanese Patent Office in corresponding Japanese Patent Application No. 2010-212081, and an English Translation of the Office Action. (8 pages).

* cited by examiner

GAS TURBINE

This application claims priority to European application no. 09171142.4, filed 23 Sep. 2009, the entirety of which is incorporated by reference herein.

BACKGROUND

1. Field of Endeavor

The present invention relates to a gas turbine.

In particular the present invention refers to the sealing of the zone between the guide vane boxes of the high-pressure turbine immediately downstream of the combustion chamber and a fixed frame, such that possible leakages of hot gases flowing in the combustion chamber and/or compressed air used to seal the zone between the combustion chamber and stator airfoil row do not enter the rotor airfoils cooling circuit.

2. Brief Description of the Related Art

In the following reference, will be made to FIG. 1 for describing the relevant parts of the gas turbine; in particular reference will be made to a sequential combustion gas turbine, it is anyhow clear that structures embodying principles of the present invention may be implemented in any gas turbine also not being a sequential combustion gas turbine.

Sequential combustion gas turbines 1 have a compressor (not shown) compressing air and supplying it to first burners (not shown) where fuel is injected and a mixture to be combusted is formed.

Downstream of the first burners a first combustion chamber 2 is provided, where the mixture is combusted to form high pressure hot gases F that are supplied to a high-pressure expansion stage.

The high-pressure expansion stage includes a stator airfoil row 4 separated from the combustion chamber 2 by a first gap 5, and a rotor airfoil row 6 separated from the stator airfoil row 4 by a second gap 7; third gaps 8 are provided between the rotor airfoil row 6 and an annular duct 9 feeding a plurality of side-by-side second burners 10, wherein further fuel is injected in the hot gases (still rich in air) already partially expanded in the high-pressure expansion stage, such that an ignitable mixture is formed. This ignitable mixture is combusted in a second combustion chamber (not shown) and the hot gases produced are further expanded in a low pressure turbine (not shown).

The stator airfoil row 4 is made of stator airfoils 15 defining between each other guide vanes and having endwalls 16 connected to guide vane boxes 17.

The guide vane boxes 17 have a box structure and are fed with cooling air A via connections not shown for simplicity.

In particular, the cooling air A comes from the compressor at a temperature of about 450-550° C. and is cooled by an external cooler to a temperature of typically 200-400° C.

Moreover the guide vane boxes 17 are also provided with nozzles 20 that inject the cooling air A into the second gap 7.

The rotor airfoil row 6 includes a plurality of rotor airfoils 22 having a hollow body provided with an inlet 23 arranged to collect the cooling air A injected from the nozzles 20.

During operation, the hot gases F formed in the first combustion chamber 2 pass through the stator and rotor airfoil row 4, 6 such that the rotor airfoil row 6 extracts mechanical power from them.

Moreover, the air A from the guide vane boxes 17 is injected through the nozzles 20 in the second gap 7 towards the rotor airfoil inlets 23.

As the rotor airfoil row 6 rotate with high speed, it draws the cooling air A injected from the nozzles 20 and makes it to enter the rotor airfoil 22 via the inlets 23.

The cooling air A entering the rotor airfoils 22 cools the rotor airfoils 22 and is then injected through holes (usually at the leading edge and trailing edge of each rotor airfoil row); the air injected through the leading and trailing edges of the rotor airfoils 22 is indicated by A2.

In order to prevent the hot gases F from entering the first gap 5 (the hot gases have a temperature of about 1200-1500° C. and would impair the components close to the first gap 5), compressed air (the so-called 'purge air') is diverted from the compressor and is injected in the first gap 5. This air has a temperature of about 450-550° C. and thus is not dangerous for the components close to the gaps 5.

In addition, in order to prevent the compressed air (purge air) from reaching the rotor airfoil inlet 23, seals 25 are provided between the stator airfoil endwalls 16/guide vane boxes 17 and a fixed frame 26.

Nevertheless, the compressed air diverted from the compressor may leak and pass through the seals 25 and mix with the cooling air A injected in the second gap 7.

For this reason, the cooling air A flow rate is quite large, such that, in all operating conditions, the air entering the rotor airfoil 22 has a correct temperature to safeguard the rotor airfoil integrity and guarantee their lifetime.

Nevertheless, since the cooling air A flow rate diverted from the compressor into the guide vane boxes is quite large, efficiency of the gas turbine is reduced.

FR 1 351 268 discloses a guide vane box with openings from which compressed air is injected to enter cooling conduits of the rotor airfoils.

GB 2 246 836 discloses a guide vane with first and second passages; from these passages cooling air is injected into cooling passages of the rotor airfoils. The second passages can be blocked off by a Belleville washer.

EP 0 636 765 discloses guide vane boxes with passages from where a flow is injected into rotor airfoil inlets of a rotor cooling circuit.

SUMMARY

One of numerous aspects of the present invention includes a gas turbine by which the aforementioned problems of the known art are addressed.

Another aspect of the present invention includes a gas turbine having an increased efficiency when compared with traditional gas turbines.

BRIEF DESCRIPTION OF THE DRAWINGS

Further characteristics and advantages of the invention will be more apparent from the description of a preferred but non-exclusive embodiment of the gas turbine according to the invention, illustrated by way of non-limiting example in the accompanying drawings, in which.

DETAILED DESCRIPTION OF EXEMPLARY EMBODIMENTS

Figure 1:
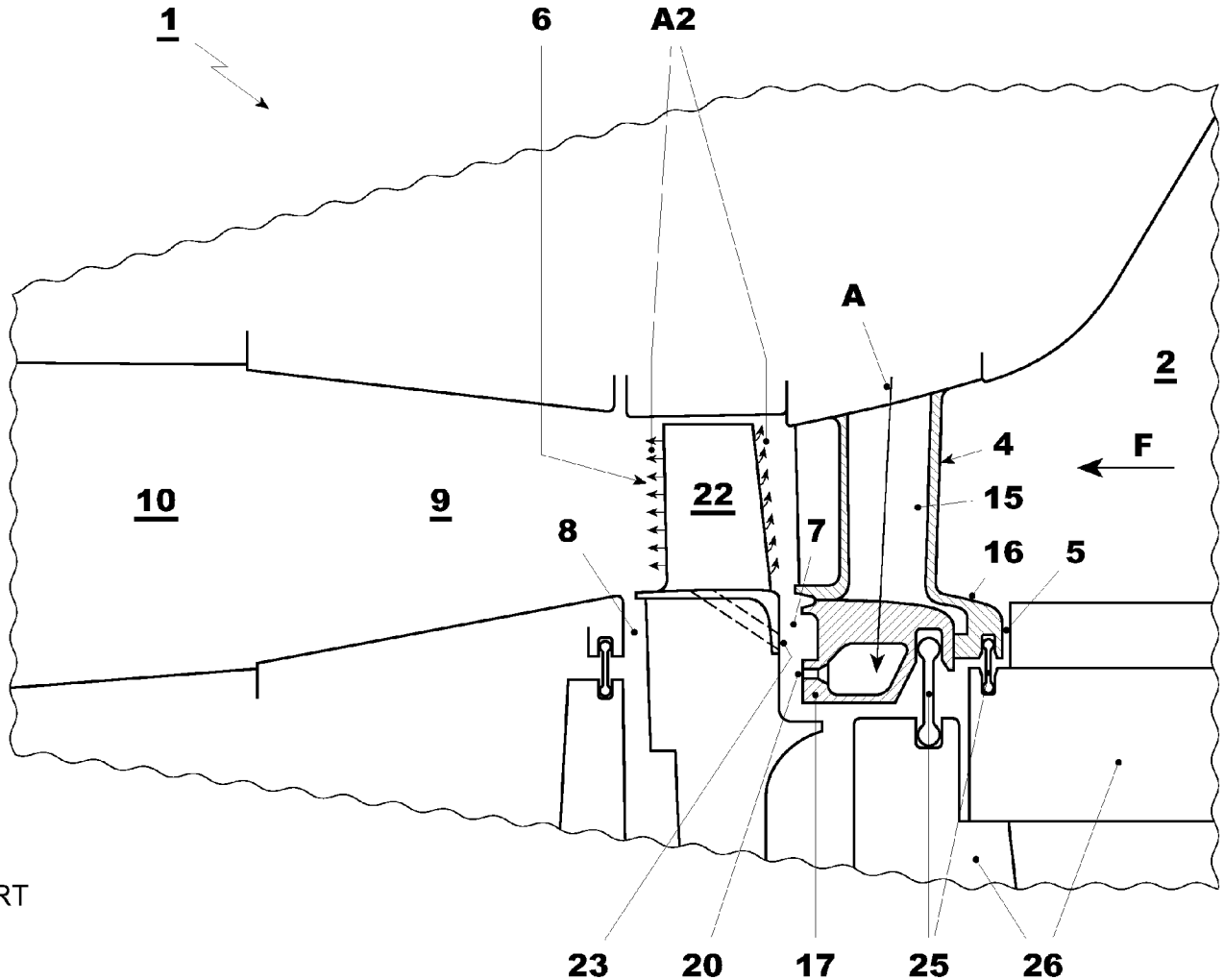
PRIOR ART FIG. 1
FIG. 1 shows a schematic cross section of a portion of a gas turbine according to the prior art.

With reference to the figures, these show a gas turbine 1 having the combustion chamber 2 followed by the stator airfoil row 4 and the rotor airfoil row 6.

The structure of the gas turbine is the same as that already described; it is thus not described again and with the same reference numbers the same elements are indicated.

In particular, the guide vane boxes 17 are provided with passages 30 connecting a zone 31 upstream of the guide vanes boxes 17 to a zone 32 of the second gap 7 downstream of the guide vanes boxes 17.

In addition, the mouth 34 of the passages 30 facing the rotor airfoil row 6 is closer to a hot gases path 35 than the nozzles 20.

The mouth 34 of the passages 30 facing the rotor airfoil row 6 is substantially as close as, or it is closer than, the rotor airfoil inlet 23 to the hot gases path 35. This permits the flow going out from the mouth 34 not to be drawn from the rotor airfoil row 6 to enter the inlet 23.

Figure 4:
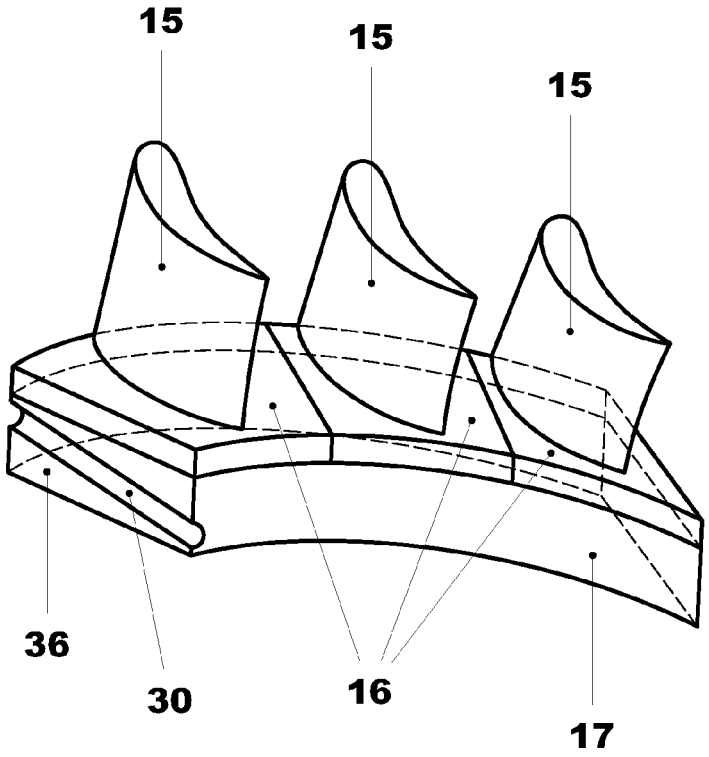

In a first embodiment (FIG. 4), the passages 30 are defined by slots at sidewalls 36 of the guide vane boxes 17.

In this embodiment, the two contacting sides of two adjacent guide vane boxes may be provided with the slot, such that the passages 34 are defined between two facing slots.

Alternatively only one of the two contacting sidewalls 36 of the adjacent guide vane boxes 17 may be provided with the slot, in which case the passages 30 are defined by the slot of a guide vane box 17 and the flat surface of the adjacent guide vane box 17.

Figure 3:
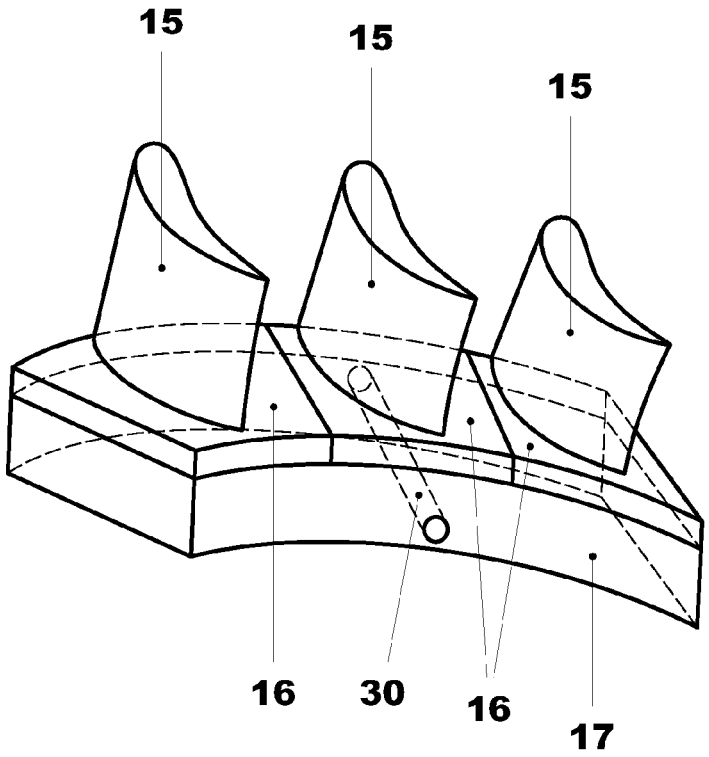
FIGS. 3 and 4 show a particular of guide vane boxes according to two embodiments of the invention.

In a different embodiment (FIG. 3), the passages 30 extend inside of the guide vane boxes 17 and are defined by pipes.

Naturally, in further embodiments the guide vane boxes may be provided with both the slot and the pipes.

In addition, a seal 37 is provided downstream of the mouths 38 of the passages 30 opposite the rotor airfoil row 6, between the guide vane boxes 17 and the fixed frame 26. This lets the leakage that may overcome the seals 25 be withheld in a zone separate from the rotor airfoil row 6.

The operation of the gas turbine of the invention is apparent from that described and illustrated and is substantially the following.

The hot gases pass through the hot gases path 35 and thus they pass through the combustion chamber 2, the stator airfoil row 4, and the rotor airfoil 6.

Through the first gap 5 compressed air (purge air) is supplied in the combustion chamber 2.

A part of the compressed air (purge air) may leak, overcoming the seals 25 to enter the zone 31 upstream of the guide vane boxes 17.

Thanks to its high pressure (greater than the pressure inside of the second slot 7), the compressed air (purge air) enters the passages 30 through the mouths 38, passes through the passages 30 and moves out through the mouths 34 entering the second gap 7 in a zone from where it cannot enter the rotor airfoil inlet 23; thus the compressed air (purge air) enters the hot gases path 35.

The additional seal 37 keeps this compressed air (purge air) in a zone adjacent to the mouth 38 of the passage and prevents the high temperature compressed air from being drawn from the high speed rotating rotor airfoil row 6.

Figure 2:
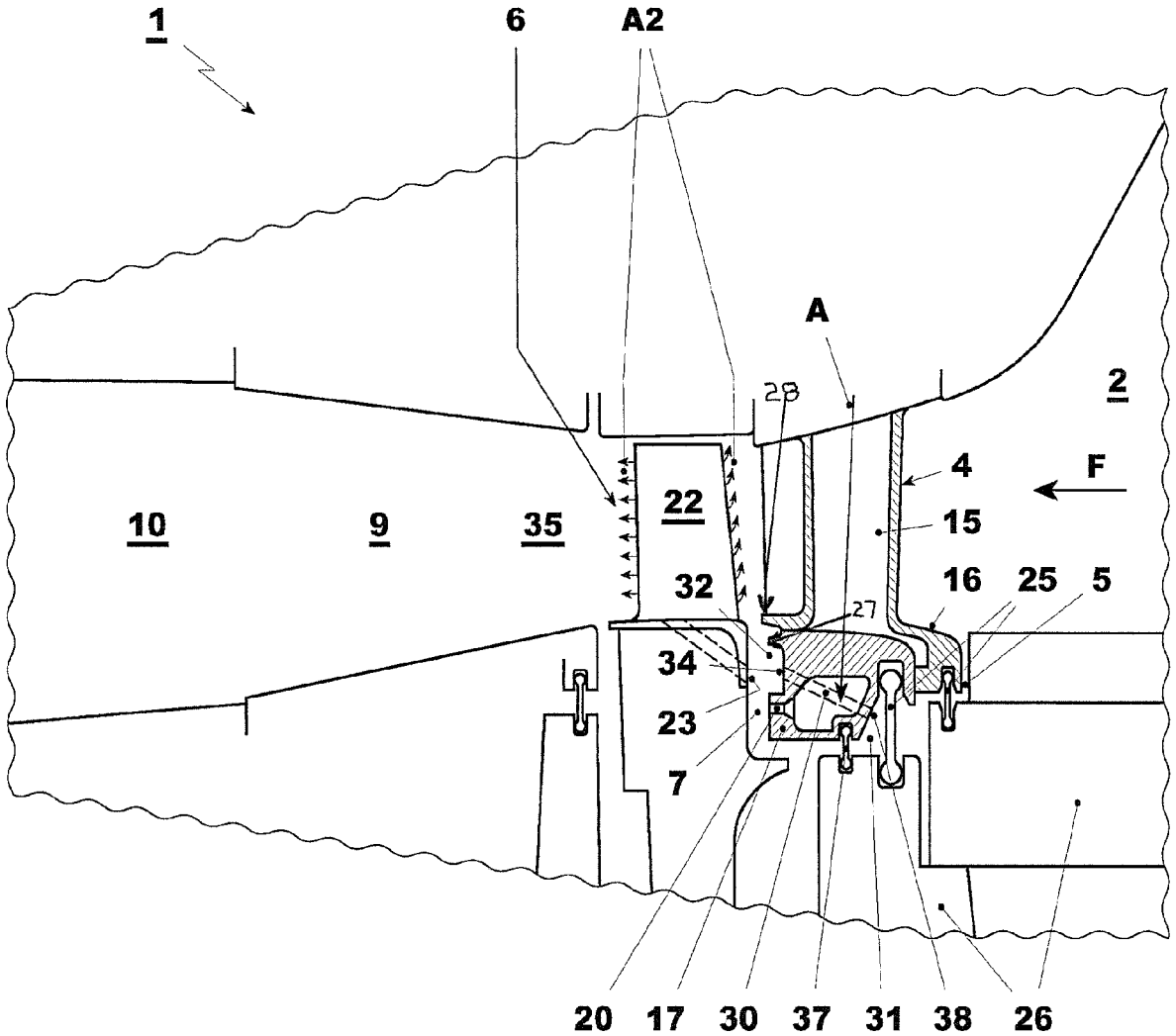
FIG. 2 shows a schematic cross section of a portion of a gas turbine according to the invention.

As shown in FIG. 2, the vane includes a platform 28 having an extension which extends to at least partly close the gap separating the rotor airfoil from the stator airfoil row. The mouths of the passages connecting a zone upstream of the guide vane boxes to a zone of the gap downstream of the guide vane boxes are below the platform extension on a side facing away from a hot gas flow path. The guide vane boxes each include an extension 27 which divides the gap into a radially inner section of the guide vane boxes and a radially outer section side facing the gap. Each of the passage mouths are positioned at a gap in a radially inner section.

The gas turbine conceived in this manner is susceptible to numerous modifications and variants, all falling within the scope of the inventive concept; moreover all details can be replaced by technically equivalent elements.

In practice the materials used and the dimensions can be chosen at will according to requirements and to the state of the art.

REFERENCE NUMBERS

1 gas turbine
2 combustion chamber
4 stator airfoil row
5 first gap
6 rotor airfoil row
7 second gap
8 third gap
9 annular gap
10 second burner
15 stator airfoils
16 endwalls of 15
17 guide vane boxes
20 nozzles
22 rotor airfoils
23 rotor airfoil inlet
25 seals
26 fixed frame
30 passages
31 zone upstream of the guide vane boxes
32 zone downstream of the guide vane boxes
34 mouth of 30
35 hot gases path
36 sidewalls of 17
37 seal
38 mouth of 30
A cooling air
A2 air injected through 22
F hot gases flow While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A gas turbine, comprising:

a combustion chamber;

a compressor for supplying cooling air and air to be mixed with fuel and combusted;

a stator airfoil row defining a plurality of guide vanes and guide vane boxes wherein the stator airfoil row is separated from the combustion chamber by a first gap;

a rotor airfoil row separated from the stator airfoil row by at least a second gap, the rotor airfoil row including rotor airfoil inlets, wherein the stator airfoils of the stator airfoil row are connected to the guide vane boxes;

a hot gas flow path through which hot gases formed in the combustion chamber pass through the stator airfoil row and the rotor airfoil row, wherein the guide vane boxes include nozzles, the guide vane boxes being configured and arranged to collect cooling air and inject it through the nozzles into said second gap to make the cooling air enter the rotor airfoil inlets, wherein said guide vane boxes comprise passages connecting a zone upstream of the guide vane boxes to a zone of the second gap downstream of the guide vane boxes such that compressed air diverted from the compressor and injected into the first gap moves out from the passages through passage mouths which are positioned at the second gap in a zone from where the injected compressed air cannot enter the rotor airfoil inlet, wherein each passage includes an upstream passage mouth opposite to the rotor airfoil row and at said zone upstream of the guide vane boxes;

a fixed frame; and a first seal downstream of the upstream passage mouths between the guide vane boxes and the fixed frame and a second seal upstream of the upstream passage mouths between stator airfoil end walls and the fixed frame for sealing the first gap from the second gap.

2. A gas turbine as claimed in claim 1, wherein said passage mouths are as close as, or closer than, the rotor airfoil inlet to the hot gas flow path.

3. A gas turbine as claimed in claim 1, wherein the guide vane boxes comprise sidewalls, and said passages are defined by slots at said sidewalls.

4. A gas turbine as claimed in claim 1, wherein said passages extend inside of the guide vane boxes.

5. A gas turbine as claimed in claim 4, further comprising pipes defining said passages.

6. A gas turbine as claimed in claim 1, wherein passage mouths facing the rotor airfoil row are closer to a hot gas flow path than said nozzles.

7. A gas turbine as claimed in claim 1, wherein the passages connecting the zone upstream of the guide vane boxes to the zone of the second gap downstream of the guide vane boxes bypass a volume of the guide vane boxes for collecting the cooling fluid.

8. A gas turbine as claimed in claim 1, wherein the guide vanes comprise a platform having an extension which extends to at least partly close the second gap separating the rotor airfoil row from the stator airfoil row, and wherein the mouths of the passages connecting a zone upstream of the guide vane boxes to a zone of the second gap downstream of the guide vane boxes are radially inside the platform extension on a side facing away from the hot gas flow path.

* * * * *